United States Patent [19]

Hart et al.

[11] 4,339,202

[45] Jul. 13, 1982

[54] ASPHALT WEIGH AND MIX APPARATUS AND PROCESS

[75] Inventors: Wallace L. Hart, Evanston, Ill.; John W. Ricketts, Joplin, Mo.

[73] Assignee: UIP Engineered Products Corporation, Addison, Ill.

[21] Appl. No.: 142,432

[22] Filed: Apr. 21, 1980

[51] Int. Cl.[3] ..... B28C 7/04

[52] U.S. Cl. ..... 366/8; 366/15; 366/18

[58] Field of Search ..... 366/7, 8, 15, 18, 141, 366/152

[56] References Cited

U.S. PATENT DOCUMENTS 808,599 12/1905 Crichfield ..... 366/18
3,041,049 6/1962 Tarukawa ..... 366/152
3,058,622 10/1962 Ballestra ..... 366/18 X
3,580,551 5/1971 Hammann et al. ..... 366/15
3,697,054 10/1972 Moratschek ..... 366/18

FOREIGN PATENT DOCUMENTS 790898 2/1958 United Kingdom ..... 366/18

*Primary Examiner*—Philip R. Coe
*Attorney, Agent, or Firm*—Ronald E. Barry

[57] ABSTRACT

An apparatus for weighing and mixing asphalt and a stabilizer by weight, the apparatus including a weigh bucket and a weigh hopper, the asphalt and stabilizer being fed to the bucket and hopper simultaneously and discharged to an intermediate mixer when the predetermined weight ratio has been fed to the bucket and hopper, the asphalt stabilizer composition being mixed for a predetermined period of time and fed to a surge mixer, the cycle being repeated whenever the surge mixer is not filled.

6 Claims, 5 Drawing Figures

ASPHALT WEIGH AND MIX APPARATUS AND PROCESS

BACKGROUND OF THE INVENTION

The present method of mixing asphalt and stabilizer has been basically the same for a number of years. This method utilizes a mixing chamber having multiple rotating paddles into which asphalt and filler are introduced in measured amounts. After thorough mixing, the composition is discharged from a single opening into a processor holding vessel. The measuring of the asphalt and stabilizer as it is fed into the mixer is controlled by volume. The asphalt is heated and fed to the mixer by a positive displacement gear pump. This pump has a controllable speed so as to vary its output as well as measure volumetrically through the tooth spaces and revolutions per minute of the pump. The stabilizer is generally introduced either through a helicoid screw turning at a designated rpm and delivering stabilizer in measured volumetric amounts or the system uses a rotary vane feeder that receives the filler in the voids between the vanes and measures it again volumetrically.

Asphalt weight by volume, varys depending on the temperature of the asphalt, therefore any variation in asphalt temperature varys the weight per cubic foot of the asphalt. The displacement pump, which is used to deliver the asphalt, also has variables in the degree of accuracy or efficiency of the pump thus producing variables in measuring the amount fed to the mixer. The accuracy of the pump is also affected by the pressure at which the asphalt is brought up to the pump. Any variation in pressure can change the measurement of the asphalt as it passes through the pump.

With respect to the stabilizer, there are a number of materials that can be used for this purpose. However, each stabilizer has a wide variation in weight by cubic measurement. Dolemite and limestone, depending on the grading and the region or country from which it is procured, can vary from 60 to 80 lbs. per cubic foot. Slate dust, oyster shells, available in the southern areas of the country, and fly ash are also used as stabilizers. Each of these also varies in weight, both with respect to each other and with respect to the other materials mentioned.

The equipment used for volumetric measurement of the stabilizer also has inherent variables. The wear factor on a rotary helicoid screw is very great and as the wear occurs the amount of material delivered per revolution changes. Vane type feeders are less susceptible to wear but also have this variable. The feed-in from the hopper to either the helicoid served or to the vane feeder can vary. There is no way of knowing whether the amount of material delivered to the screw or vane is consistent with what the screw or vane will take away.

SUMMARY OF THE INVENTION

The process and apparatus of the present invention provides a constant weight ratio of asphalt to stabilizer in the composition mix regardless of temperature or other environmental changes. The process is based on the use of weight as the criteria for controlling the ratio of the materials to be mixed. The process involves the simultaneously filling of separate containers with asphalt and stabilizer. The containers are weighed as they are being filled and the flow of asphalt or stabilizer stopped when a predetermined amount, by weight, has been delivered to each of the containers. The materials in the containers are then discharged into an interface mixer where the materials are mixed for a predetermined period of time prior to being fed to a surge tank or mixer. The asphalt and stabilizer composition is held in the surge tank or surge mixer until required for delivery to the process. The surge tank or mixer has the capacity to hold three or four times the amount of composition that is contained in the asphalt and stabilizer containers at one time. Thus, the surge tank or mixer can be discharged to process at a continuous rate of flow.

IN THE DRAWINGS

DETAILED DESCRIPTION OF THE INVENTION

Apparatus

Figure 1:
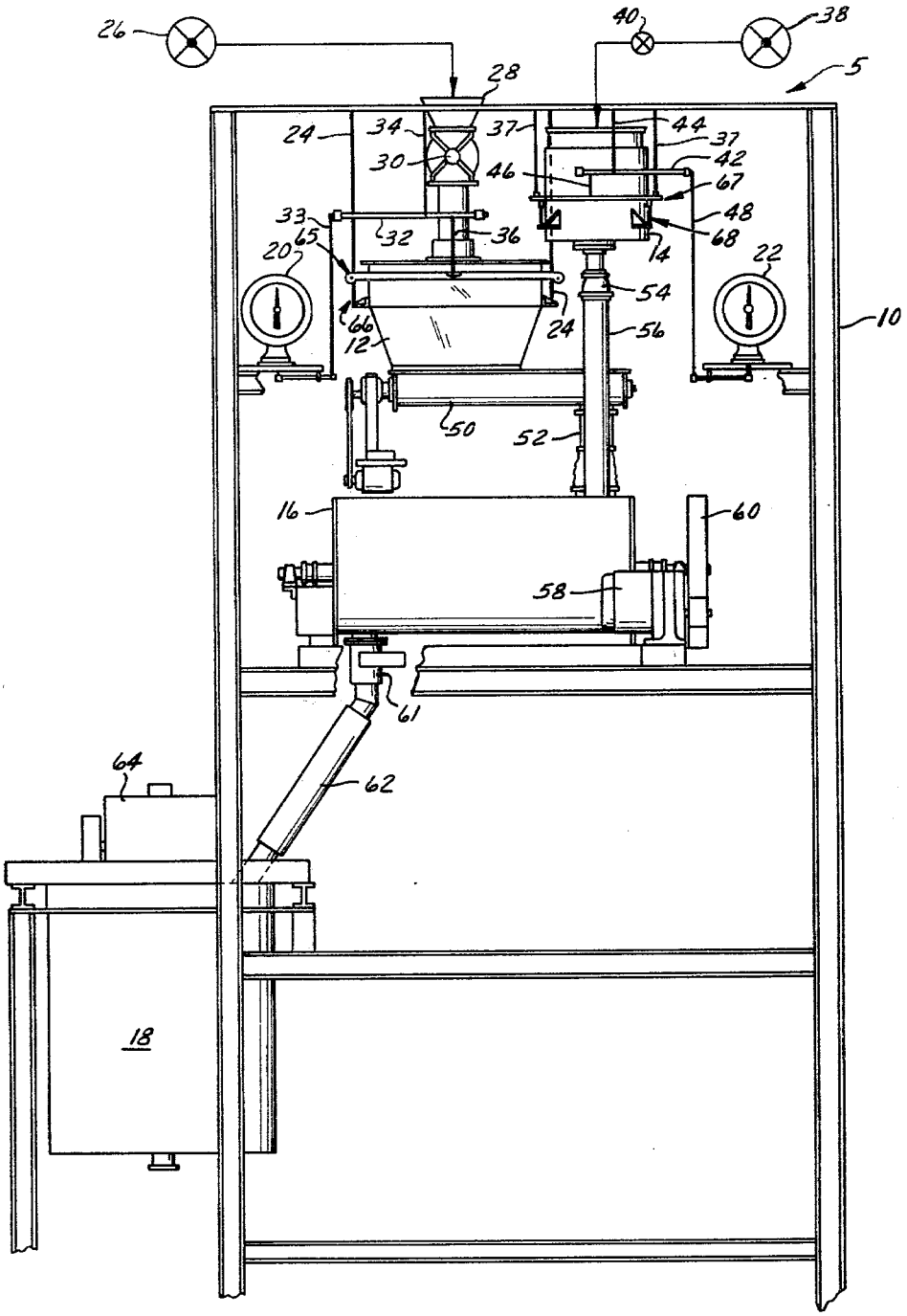
FIG. 1 is a front elevation view of the apparatus used to practice the process according to the invention.
Figure 2:
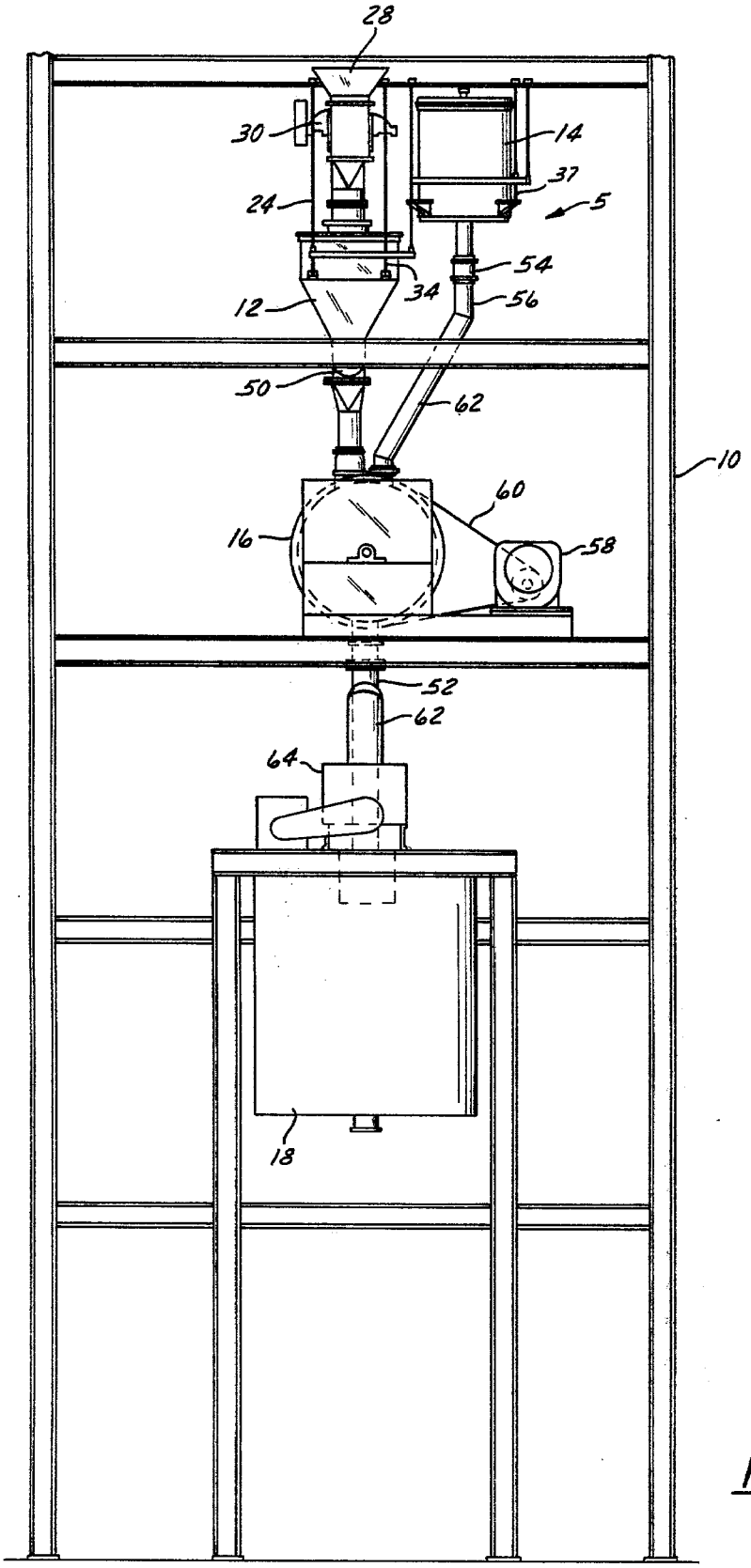
FIG. 2 is an end view of the apparatus shown in FIG. 1.
Figure 3:
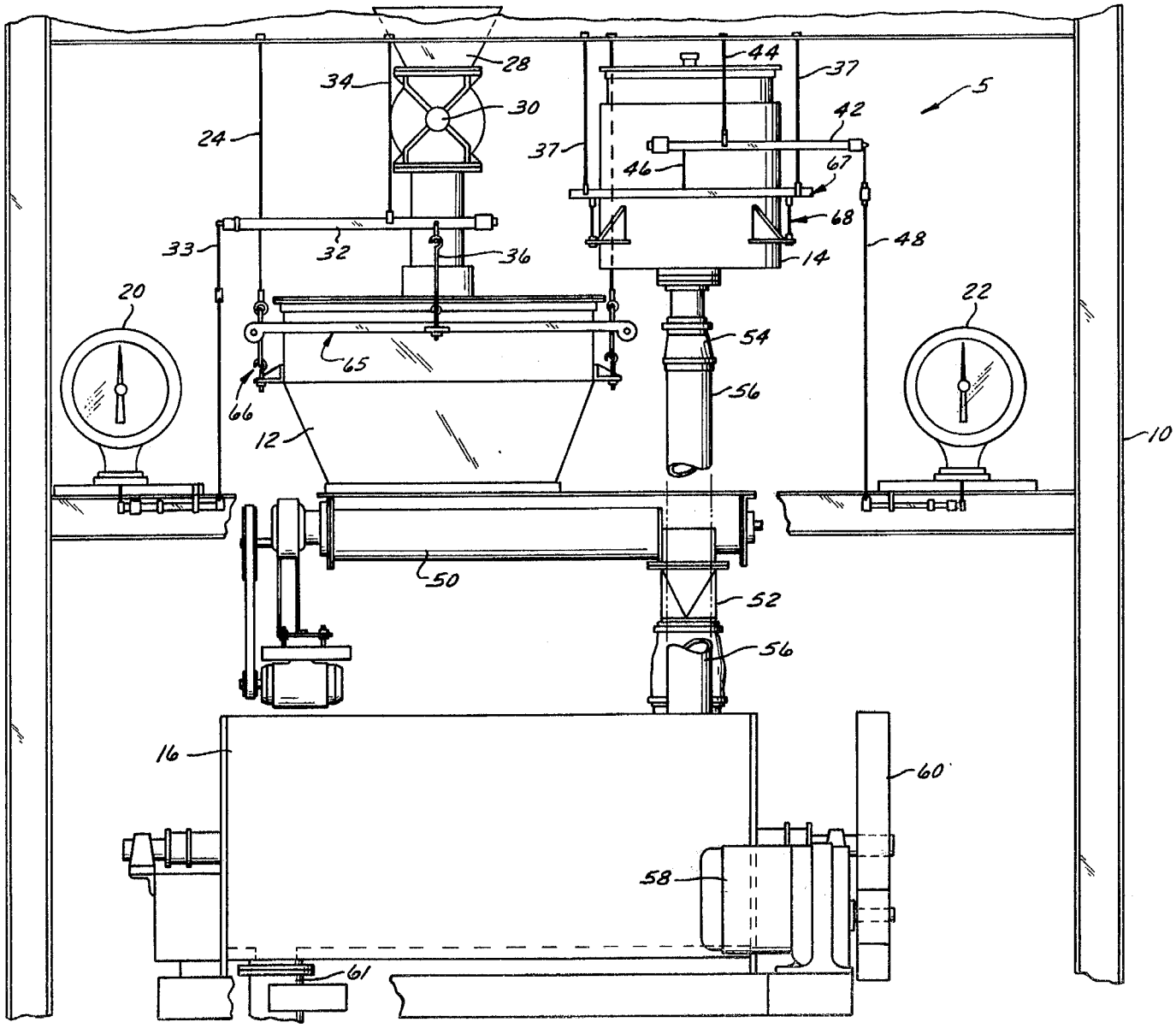
FIG. 3 is an enlarged view of the weighing apparatus.

The apparatus 5 according to the present invention, generally includes a frame 10 for supporting a stabilizer weigh hopper or container 12, an asphalt weigh bucket or container 14, an intermediate mixer 16 and a surge mixer 18. The weigh hopper 12 is suspended from a beam scale 20. The weight bucket 14 is suspended from a beam scale 22.

Stabilizer from a source 26 and asphalt from a source 38 are fed by gravity feed or any other mechanical means to the weigh hopper 12 and bucket 14. The beam scales 20 and 22 record the weight of the stabilizer and asphalt as it is fed into the weigh hopper 12 and weigh bucket 14. Circuit means are provided for automatically stopping the flow of stabilizer and asphalt after a predetermined weight has been fed to the hopper 12 and bucket 14. After both the weigh hopper and bucket are filled, the stabilizer and asphalt are fed to the intermediate mixer 16.

In this regard, it should be noted that initial mixing of the asphalt and stabilizer occurs in the intermediate mixer 16. The mixed composition is then fed to the surge mixer 18 where it is held until needed for the process.

Stabilizer is fed from a source 26 to a hopper 28 by any convenient means and then transferred to the weigh hopper 12 by gravity or by means of a rotary vane feeder 30. The balance beam 32 is connected to the beam scale 20 by a line 33. The rotary vane feeder 30 is automatically shut off when a predetermined weight is registered on the beam scale 20.

The balance beam 42 is connected to the beam scale 22 by a line 48. The valve 40 is opened to allow the asphalt to be pumped into the weigh bucket 14. When the beam scale 22 reaches the predetermined weight, the valve 40 is closed.

The stabilizer in the weigh hopper 12 is fed to the intermediate mixer 16 by means of a screw conveyor 50 through an inlet pipe 52 connected to the intermediate mixer 16. The asphalt is fed through a valve 54 into an inlet tube 56 connected to the intermediate mixer 16. The asphalt and stabilizer flow by gravity simultaneously through the inlet tubes 52 and 56 into the intermediate mixer 16 where the asphalt and stabilizer are thoroughly mixed prior to delivery to the surge mixer 18.

By simultaneously feeding the asphalt and stabilizer into the intermediate mixer 16, it is premixed prior to delivery to the surge mixer 18. The intermediate mixer 16 is driven by means of a motor 58 and a belt 60. To assure adequate mixing, means are provided for controlling the time of mixing in the intermediate mixer. Such means is in the form of a timer 59.

Means are provided for continuous mixing of the composition held in the surge mixer 18. Such means is in the form of a motor 64 provided on the mixer to drive a mixer assembly in the mixer 18.

As soon as the stabilizer weight hopper 12 and asphalt weight bucket 14 are emptied, they are immediately refilled preparatory to delivery to the intermediate mixer 16. If the surge mixer 18 is not full when the intermediate mixer 16 is emptied, the weigh hopper 12 and weigh bucket 14 are immediately discharged to the intermediate mixer and fed to the surge mixer. As soon as the weigh hopper 12 and weight bucket 14 are emptied, they will again be refilled. If the surge mixer 18 has not been filled when the intermediate mixer 16 is emptied, the weigh hopper 12 and weigh bucket 14 will again be discharged into the intermediate mixer 16. This process is repeated until the surge mixer 18 is filled at which time the weigh hopper 12 and weigh bucket 14 will be held until the level of the asphalt-stabilizer composition in the surge mixer is below a prescribed level. The surge mixer 18 will hold approximately four times the combined weight of the asphalt weigh bucket and stabilizer weigh hopper so that a continuous flow of asphalt composition can be delivered for process from the surge mixer 18. If a continuous process is being carried on, continuous delivery of weighed amounts of asphalt and stabilizer will be delivered to the intermediate mixer to maintain a proper level of composition in the surge mixer.

In handling asphalt and stabilizer, it may be necessary to maintain a certain temperature to allow for the free flow of the asphalt and stabilizer. All of the containers and conduits used for the handling of the asphalt and stabilizer are therefore provided with jackets 62 to allow for the flow of high temperature fluid, such as oil or steam, through the jackets to maintain the temperature of the asphalt and stabilizer.

OPERATING SYSTEM

Figure 4:
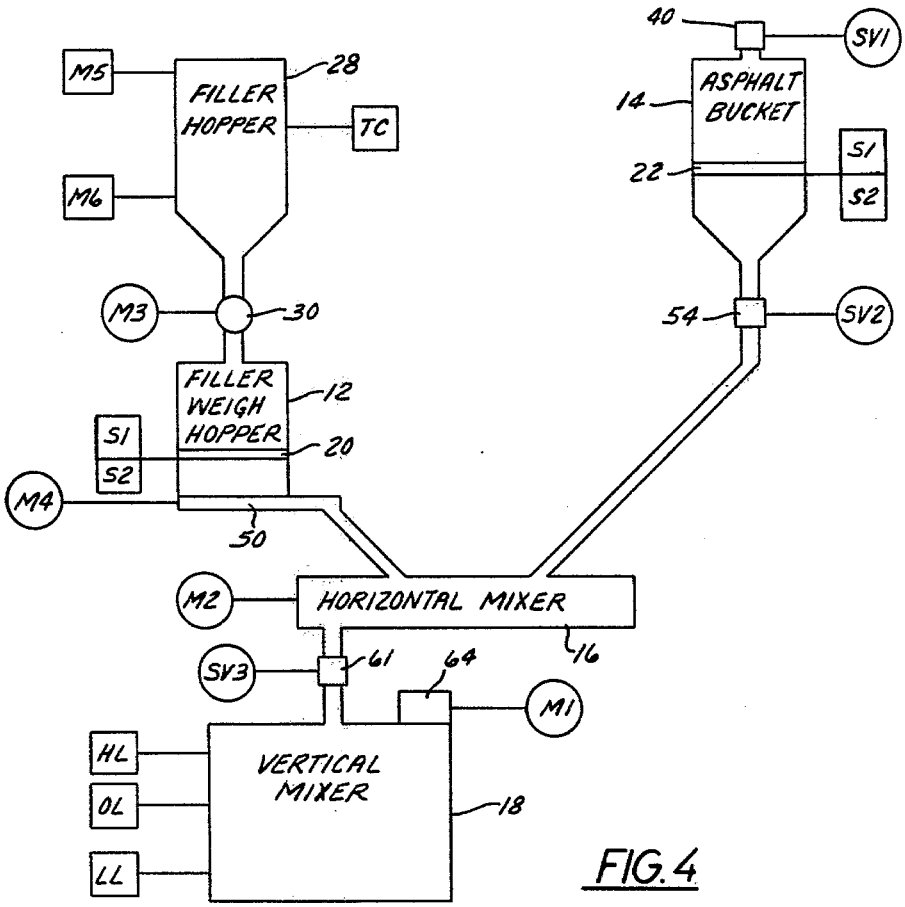
FIG. 4 is a schematic view of the weigh process system showing the location of the switches used to control the apparatus.

Referring to FIG. 4, a schematic diagram of the drive elements for the weigh system is shown. Switch locations for the various switches used to control the drive elements are also located in the figure. In this regard the filler hopper 28 includes high and low level switches M5 and M6 which indicate the level of filler in the hopper. A temperature control switch TC is also provided to maintain the proper temperature of the filler. The filler or stabilizer is fed by means of the rotary valve 30 which is controlled by a switch M3 into the filler weigh hopper 12. The weight of the stabilizer in the hopper is sensed by switches S1/S2. The filler in the weigh hopper is fed to the horizontal mixer 16 by the screw conveyor 50 which is driven by a motor M4.

The asphalt weigh bucket 14 is fed through a valve 40 controlled by a switch SV1. The asphalt in the bucket 14 is weighed by the scale 22 and sensed by switches S1/S2. Asphalt from the bucket is fed through a valve 54 controlled by a switch SV2 to the horizontal mixer 16.

The horizontal mixer 16 is driven by a motor M2 and the mixed material is fed through a valve 61 controlled by a switch SV3 to the vertical mixer 18. The material in the vertical mixer is continuously mixed by a mixing member 64 driven by a motor M1. The level of material in the vertical mixer is sensed by high and low level pressure switches HL and LL respectively and a holding switch OL is used to control the operation of the system whenever the material within the vertical mixer is below the high level or above the low level in the mixer.

ELECTRIC CIRCUIT DIAGRAM

Figure 5:
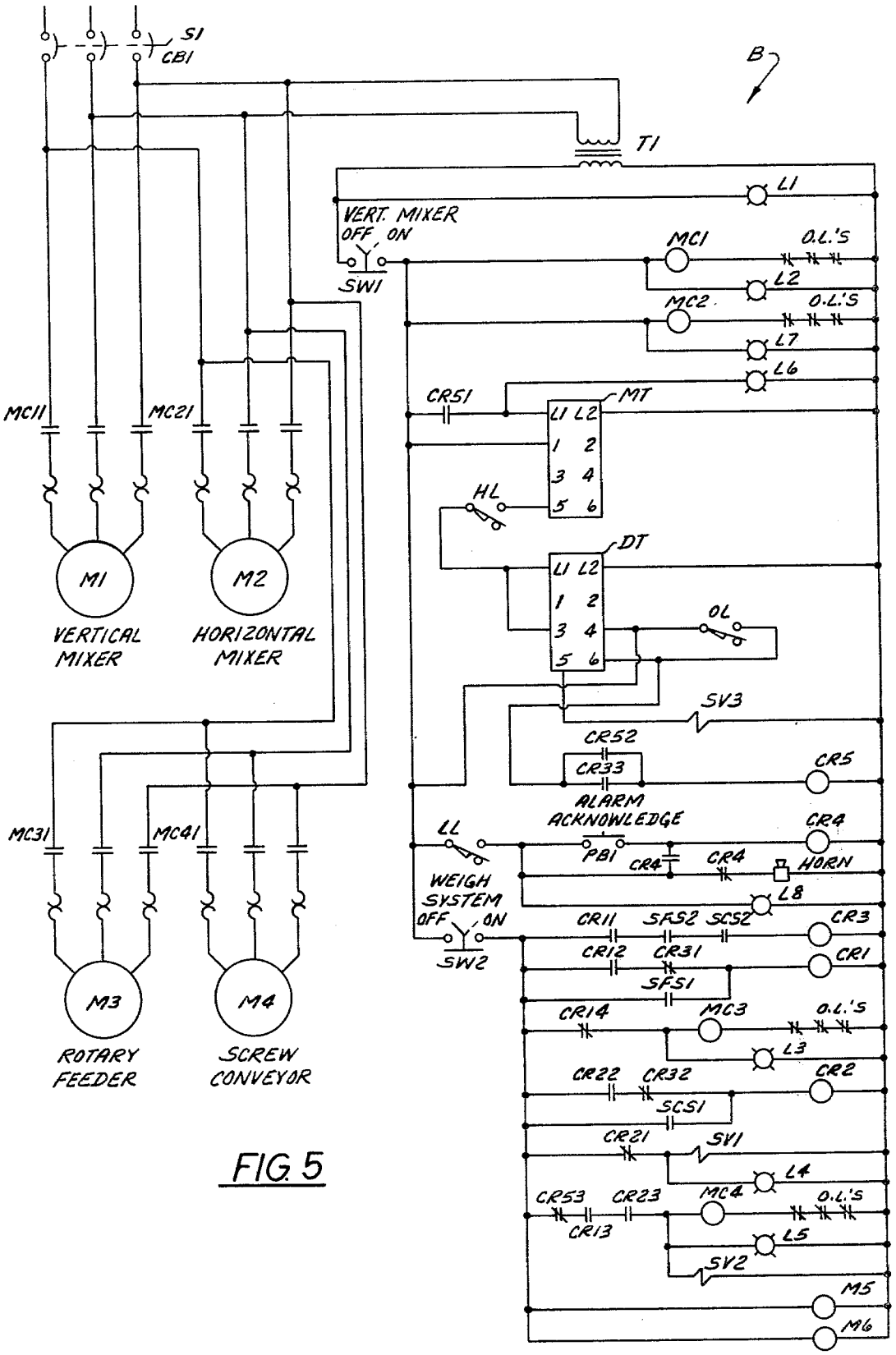
FIG. 5 is an electric circuit diagram for the apparatus.

The electric circuit diagram for the system is shown in FIG. 5. As seen in the diagram, the motor circuit A for vertical mixer motor M1, horizontal mixer motor M2, rotary feeder motor M3 and screw conveyor motor M4 are connected directly across the power lines and are controlled by motor control switches, MC11, MC21, MC31, and MC41, respectively. The switches are controlled by a switch control circuit B connected to the secondary of a transformer T1 which is connected across the power lines. The sequence of operation of the motor control switches MC11, MC21, MC31, and MC41 is controlled by a number of corresponding motor control relays MC1, MC2, MC3, and MC4.

In this regard, the control circuit B generally includes two manually operated switches SW1 and SW2. SW1 is closed to turn on the vertical mixer motor M1 by energizing relay MC1 and the horizontal motor mixer M2 by energizing the relay MC2. A number of overload switches O.L.'S are provided in each of the circuits for the relays MC1 and MC2. The vertical mixer M1 and horizontal mixer M2 run continuously until switch SW1 is opened.

The weigh system is turned on by closing switch SW2 to energize relay MC3 and switch SV1. Energizing switch SV1 opens valve 40 allowing asphalt to flow into bucket 14. Energizing relay MC3 closes the normally open relay switches MC31 for the rotary feeder motor M3.

When the stabilizer weigh hopper 12 is filled, the normally open filler scale weigh switch SFS1 will close energizing the control relay CR1. The normally open relay switches CR11, CR12 and CR13 will close and the normally closed relay switch CR14 will open. Opening the normally closed relay switch CR14 de-energizes relay MC3 stopping motor M3. Closing switch CR12 sets up a holding circuit for relay CR1. Closing switch CR11 and CR13 establishes a preliminary condition for energizing relay CR5, relay MC4 and switch SV2 for dump valve 54.

When the asphalt scale weigh switch SCS1 closes, the control relay CR2 will be energized opening normally closed switch CR21 to the switch SV1 closing the valve 40 and closing the normally opened control switches CR22 and CR23. The closed switch CR22 sets up a holding circuit to the relay CR2 and the closed switch CR23 completes the circuit to the motor control relay MC4 and switch SV2. Closing both of the normally open relay switches CR13 and CR23 initiates the flow of both stabilizer and asphalt to the horizontal mixer 16 by completing the circuit to the motor control relay MC4 and the asphalt discharge valve SV2.

When the weight of the stabilizer and asphalt reaches zero, the filler scale zero switch SFS2 will close and the asphalt scale zero switch SCS2 will close energizing the scales' empty relay CR3. The two normally closed relay switches CR31 and CR32 will open and the normally open relay switch CR33 will close. Opening switch CR31 de-energizes relay CR3. Opening switch CR32 de-energizes relay CR2. Closing switch CR33 energizes the mix and dump relay CR5.

De-energizing of the control relay CR1 recloses the normally closed control relay switch CR14 to the relay MC3 which starts motor M3 to refill the stabilizer hopper 12. Energizing of the control relay CR2 recloses the normally closed relay switch CR21 re-energizing the switch SV1 to open the valve 40 to refill the asphalt weigh bucket. As soon as the hopper 12 and bucket 14 are again filled, the switches SFS1 and SCS1 will both reclose as in the previous operation.

Energizing relay CR5 closes normally open relay switches CR51 and CR52 and opens normally closed relay switch CR53. Closing switch CR51 sets up a holding circuit to relay CR5 and closing switch CR52 energizes the mixing time relay MT. Opening switch CR53 de-energizes relay MC4 stopping the screw conveyor 50 and switch SV2 closing valve 54.

If the mix and dump relay CR5 is energized when the scale switches SFS1, SCS1 are closed, the stabilizer hopper and asphalt bucket will not be emptied because the normally closed relay switch CR53 is still open.

If the mix and dump relay CR5 is energized, the mixer timer MT is also energized because the normally open switch CR5 is closed. After a preset time the normally opened switches in the mixing timer are closed to energize the delay timer DT. If the normally closed contacts of the high limit switch HL in the vertical mixer 18 is closed the mixer dump valve SV3 will open. When the delay timer DT completes its preset cycle, the normally closed contacts in the delay timer will open to de-energize the mixer dump valve SV3 and the mix and dump relay CR5. If the operating level switch O.L. is open, the mix and dump valve relay CR5 will drop out allowing the full cycle to repeat.

The embodiments of the invention in which an exclusive property and privilege is claimed are defined as follows:

1. A process for the continuous production of an asphalt-stabilizer roofing composition comprising the steps of feeding asphalt into a container, weighing the container as the asphalt is fed therein, stopping the flow of asphalt when the container is filled with a predetermined amount by weight of asphalt, simultaneously, feeding stabilizer into a second container, weighing the second container as stabilizer is being fed therein, stopping the flow of the stabilizer when the container is filled with a predetermined amount by weight of stabilizer, discharging the weighed asphalt and stabilizer into an intermediate mixer, refilling the asphalt container and stabilizer container, discharging the mixed asphalt and stabilizer composition after a predetermined period of time from the intermediate mixer into a surge mixer for delivery to process and repeating the process when the level in the surge mixer reaches a predetermined minimum and continually repeating the process until the level in the surge mixer reaches a predetermined maximum.

2. The process according to claim 1 including the further step of heating the stabilizer and asphalt as it flows through the process.

3. An apparatus for providing a continuous flow of an asphalt-stabilizer roofing composition to a process, said apparatus comprising a frame, a weigh bucket and weigh hopper supported on said frame, means for feeding asphalt to said bucket, means for feeding stabilizer to said hopper, zero weigh means for stopping the flow of asphalt and stabilizer fed to said bucket and hopper when the weight in each reaches a predetermined amount, an intermediate mixer mounted on said frame, means for controlling the operation of said intermediate mixer, means connected to respond to a signal from said weigh means for feeding the asphalt and stabilizer to said intermediate mixer, a surge mixer on said frame, means connected to respond to a signal from said intermediate mixer control for discharging the asphalt-stabilizer composition to said surge mixer and means responsive to the level of asphalt-stabilizer composition in the surge mixer for controlling the means for feeding asphalt and stabilizer to said weigh bucket and weigh hopper.

4. An apparatus for the continuous production of an aspahlt-stabilizer composition containing a predetermined weight ratio of asphalt to stabilizer, said apparatus comprising a weigh bucket, means for feeding asphalt into said weigh bucket, zero weigh means for stopping the flow of asphalt when the weigh bucket contains a predetermined amount by weight of asphalt, a weigh hopper, means for feeding stabilizer into said weigh hopper, zero weigh means for stopping the flow of stabilizer when the weigh hopper contains a predetermined amount by weight of stabilizer, an intermediate mixer, means for simultaneously discharging the weighed asphalt and stabilizer into said intermediate mixer, a surge mixer, means for dumping the mixed asphalt and stabilizer composition into said surge mixer for delivery to process and means for controlling the flow of asphalt and stabilizer to the intermediate mixer according to the level of asphalt-stabilizer composition in the surge mixer.

5. The apparatus according to claim 4 including means for heating the stabilizer and asphalt.

6. The apparatus according to claim 4 or 5 including means for timing the operation of the intermediate mixer, said dumping means being responsive to the timing means.

* * * * *